US005470186A

United States Patent [19]

Kwok

[11] Patent Number: 5,470,186

[45] Date of Patent: Nov. 28, 1995

[54] SYSTEM FOR DISCHARGE OF BULK MATERIALS FROM VEHICLES

[75] Inventor: Alexander K. W. Kwok, Scarborough, Australia

[73] Assignee: ABB EPT Construction Pty. Limited, Sydney, Australia

[21] Appl. No.: 421,461

[22] Filed: Apr. 12, 1995

Related U.S. Application Data

[63] Continuation of Ser. No. 117,440, Sep. 7, 1993, abandoned, which is a continuation-in-part of Ser. No. 894,021, Jun. 5, 1992, abandoned.

[30] Foreign Application Priority Data

Oct. 15, 1991 [AU] Australia ..... PK8929

[51] Int. Cl.[6] ..... B61D 7/30

[52] U.S. Cl. ..... 414/388; 105/241.2; 414/387; 414/519

[58] Field of Search ..... 105/241, 239, 105/241.2, 254, 284, 289, 290, 306, 286, 287; 414/373, 376, 377, 378, 379, 380, 387, 388, 414, 519, 520; 49/109

[56] References Cited

U.S. PATENT DOCUMENTS

| | | | |
|---|---|---|---|
| 2,686,478 | 8/1954 | Harbulak | 105/241.2 X |
| 3,452,886 | 7/1969 | Dorey | 414/388 |
| 3,459,316 | 8/1969 | McGrath | 414/388 |
| 3,474,920 | 10/1969 | Miller | 414/388 |
| 3,540,605 | 11/1970 | Nagy | 414/388 |
| 3,631,814 | 1/1972 | Shaver | 414/387 X |
| 3,633,772 | 1/1972 | Miller | 414/388 |
| 3,978,997 | 9/1976 | Miller et al. | 105/241.2 X |
| 4,259,036 | 3/1981 | Miller | 105/241.2 X |
| 4,329,106 | 5/1982 | Adler | 105/241.2 X |

FOREIGN PATENT DOCUMENTS

| | | | |
|---|---|---|---|
| 5338969 | 10/1970 | Australia . | |
| 591653 | 1/1960 | Canada | 105/241.2 |

*Primary Examiner*—Frank E. Werner
*Attorney, Agent, or Firm*—Edwin D. Schindler

[57] ABSTRACT

A system for operating hopper doors 14, 16 in a bulk transport vehicle comprises linkages 34, 36, 38, 40 forming an over-center locking arrangement and separate opening and closing trip levers 24, 50 attached to an operating shaft 30. The trip levers 24, 50 are operated by engaging associated cams 28, 54 as the vehicle is moved relative thereto. The cams 28, 54 are inactivated by being rotated, translated or lowered out of the path of the trip levers to a position where they do not trigger the operation of the doors 14, 16. A single door or pair of doors may be operated at the same time. To prevent false triggering of the door mechanism in transit, a secondary lock can be provided where a spring or counterweight is used to bias a lever which restrains a governor. The governor moves between stops which determine the angular positions corresponding to the door(s) 14, 16 being opened or closed. Cams 28, 54 may have an automatic retract feature to inactivate them in the case of accidental collision, which feature can also be used for manual control.

15 Claims, 10 Drawing Sheets

SYSTEM FOR DISCHARGE OF BULK MATERIALS FROM VEHICLES

This is a continuation of application Ser. No. 08/117,440, filed Sep. 7, 1993, now abandoned, which, in turn, is a continuation-in-part of application Ser. No. 07/894,021, filed Jun. 5, 1992, now abandoned.

The present invention relates to a system for the discharge of bulk materials from vehicles in particular railway wagons.

BACKGROUND OF THE INVENTION

Although the invention will be described with respect to railway wagons, the invention is to be understood to have application to other general forms of bulk carrier, for example road vehicles. The invention has application to the transport of bulk materials such as wheat, coal, iron ore, granular materials in general, or other solid particulate matter.

In prior art vehicles, the bulk material is stored in hoppers which have discharge openings at the base closed by doors. The doors are operated by levers which are driven "over-centre" to maintain the door shut. The over-centre levers are actuated either manually or by hydraulic or pneumatic cylinders rotating a shaft to which the over-centre levers are attached. A further manually operated lever arm is often provided should an actuating cylinder fail. Each hopper is normally provided with a pair of doors opened in unison. In order to operate the hopper doors, considerable physical exertion or a source of hydraulic or pneumatic power is required. The latter situation complicates the mechanical features of the vehicle and hence the reliability of operation as well as the cost of manufacture of the vehicle.

The discharge of particulate materials produces a dust laden atmosphere which can reduce the reliability of hydraulic or pneumatic actuators.

In other prior art, rollers on the end of door levers in cooperation with cams at trackside have been described, such as in Australian patent application No. 53,389/69 (Dorey) or in Miller, U.S. Pat. No. 3,633,772, the cams being moved into the path of the associated door operating mechanism as required. Both of these discloses involve complex mechanisms to operate doors, which mechanisms in turn become inundated with dust when operated since longitudinal door openings are used and have no provisions for preventing accidental collision therewith, for example with the locomotive pulling the wagons.

SUMMARY OF THE INVENTION

The present invention seeks to overcome the above disadvantages in the prior art or at least to substantially ameliorate them, or to provide an alternative thereto.

According to a first aspect of the invention, there is provided a system for the discharge of bulk materials from a vehicle, said vehicle having at least one storage compartment with at least one discharge opening and a door covering said at least one discharge opening, held shut by an over-centre action of a door operating mechanism having an articulated linkage said mechanism further including a first lever means for opening said door, and a second lever means for closing said door, a first cam means co-operable with said first lever means to open said door and a second cam means co-operable with said second lever means to close said door, said first and second cam means being separate from said vehicle and each having means to move it between a first inoperative position and a second operative position and vice versa, whereby in said second position said first or second cam means is in a position to contact said first or second lever means respectively as the case may be so that relative movement of said vehicle and said respective cam means opens or closes said door, and in said first position is retracted unable to contact said respective levers.

DETAILED DESCRIPTION OF PREFERRED EMBODIMENTS

Figure 1:
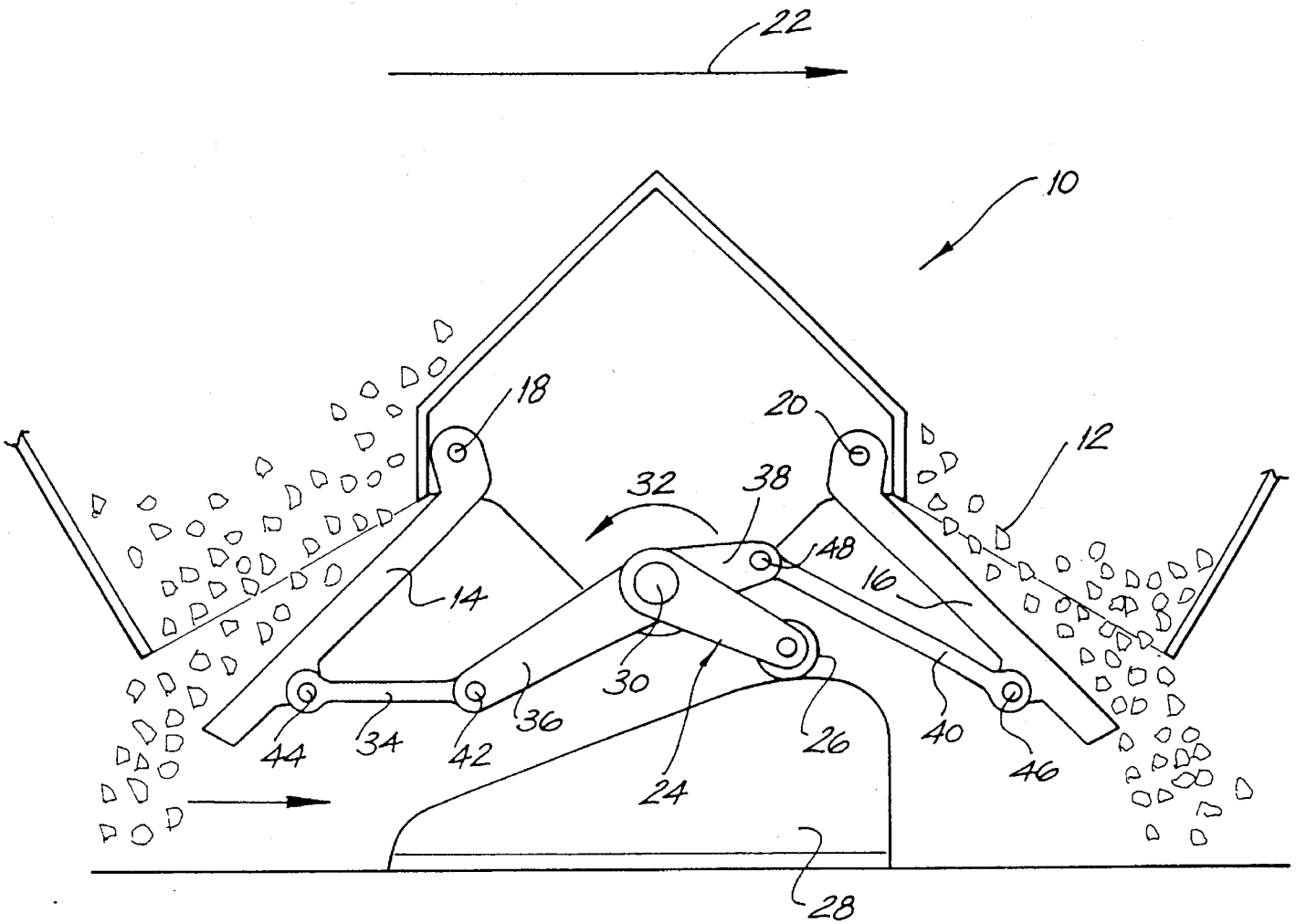
FIG. 1 shows a schematic view of the system according to a first embodiment of the invention operating to open a pair of hopper doors of a vehicle.

As shown in FIG. 1, a vehicle with a hopper 10 filled with particulate material 12 has a pair of facing hopper doors 14, 16 hinged respectively at 18, 20. The vehicle is moving in the direction of the arrow 22.

Figure 4:
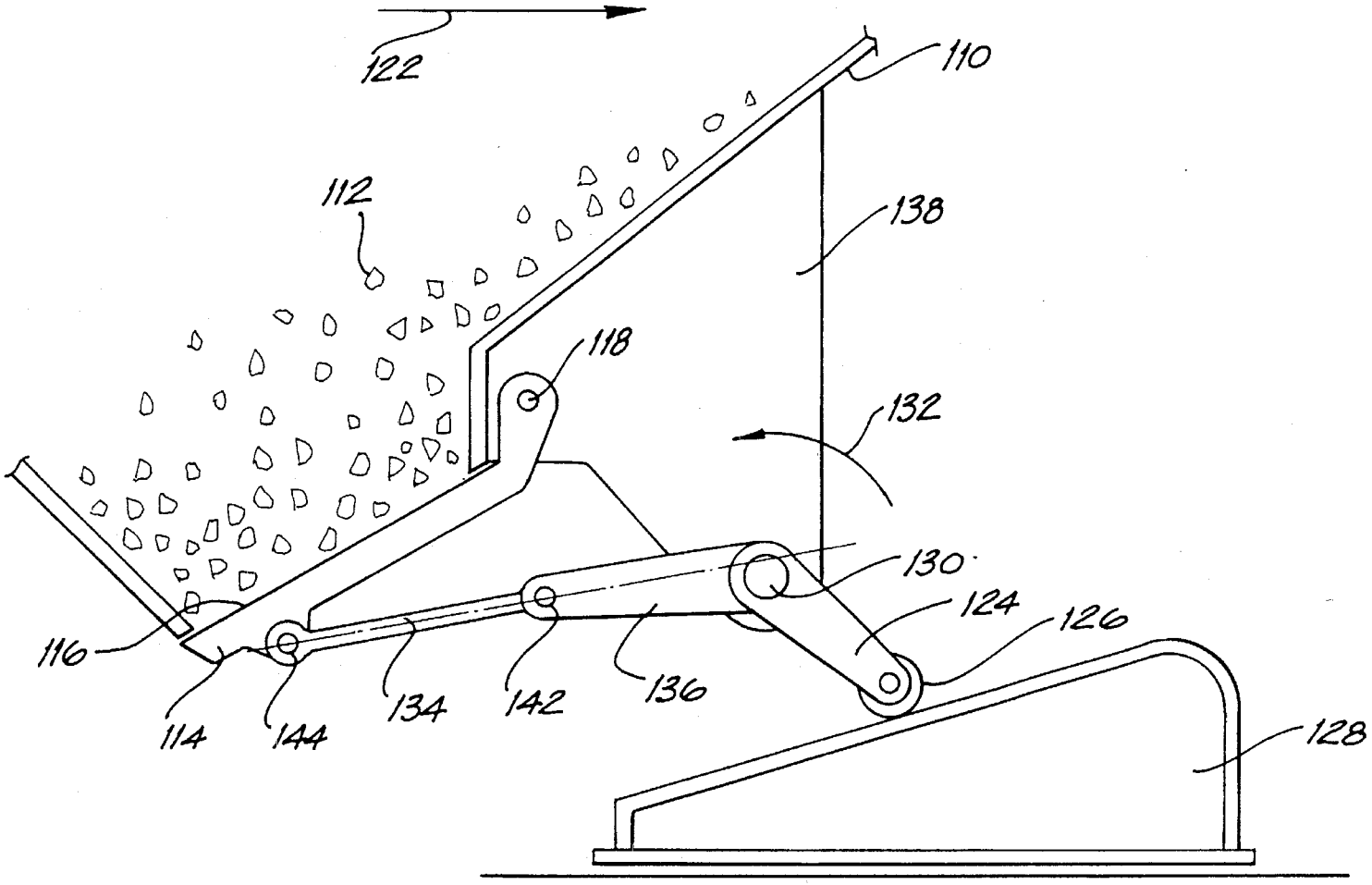
FIG. 4 shows a schematic view of the system according to a second embodiment of the invention.

The vehicle may have a single hopper 10 or a plurality of such hoppers, and more than one set of doors depending on the size of the hopper. For example, in a railway wagon, the volume defined by the wagon comprises a single storage compartment ("hopper") and a number of doors, for example four pairs, may be provided in the base of the wagon for discharge of the contained material, each pair of doors being as shown in FIG. 1. Alternatively, each discharge opening may be closed by a single door (as shown in FIG. 4) rather than a pair as shown in FIG. 1.

As the vehicle (and hence the hopper 10) moves in the direction 22 a trip lever 24 with a roller 26 at its free end contacts the surface of opening cam 28. The cam 28 may be disabled ( description of FIGS. 5–8 or 11–14). As the roller 26 ascends the surface of the opening cam 28, the lever 24 rotates the shaft 30 (to which the lever 24 is affixed) in an anti-clockwise direction as shown by arrow 32.

The doors 14, 16 are operated by levers comprising pairs of articulated linkages 34, 36 and 38, 40 respectively. First linkages 36 and 38 (of each pair) are fixed to the shaft 30 and rotate therewith. Linkages 36, 38 as shown comprise a single bar but may also be separate elements. Second linkage 34 (of the left pair) is attached to first linkage 36 at pivot 42 and to the door 14 at pivot 44. Likewise, second linkage 40 is connected to hopper door 16 at pivot 46 and to first linkage 38 at pivot 48.

The shaft 30 is fixed to the body of the hopper in a manner allowing rotation of the shaft about its axis.

In operation, the first linkages 36, 38 and second linkages 34, 40 provide in the closed position an over-centre action locking the hopper doors closed against the weight of the bulk material 12 contained in the hopper. "Over-centre" refers to the first linkage 36 or 38 not being co-linear with the associated second linkage 34 or 40 respectively. The slope of the opening cam 28 is chosen to provide the necessary leverage to overcome this locking action of the levers 34, 36 and 38, 40 or at least sufficient to allow the weight of the material once it has commenced its discharge from a partially opened door to continue further to force the door(s) fully open.

As the hopper doors 14, 16 are forced fully open by the discharge of the material 12, the trip lever 24 is rotated off the opening cam 28 into an essentially vertical orientation such that trip lever 24 is now "disabled".

Figure 2:
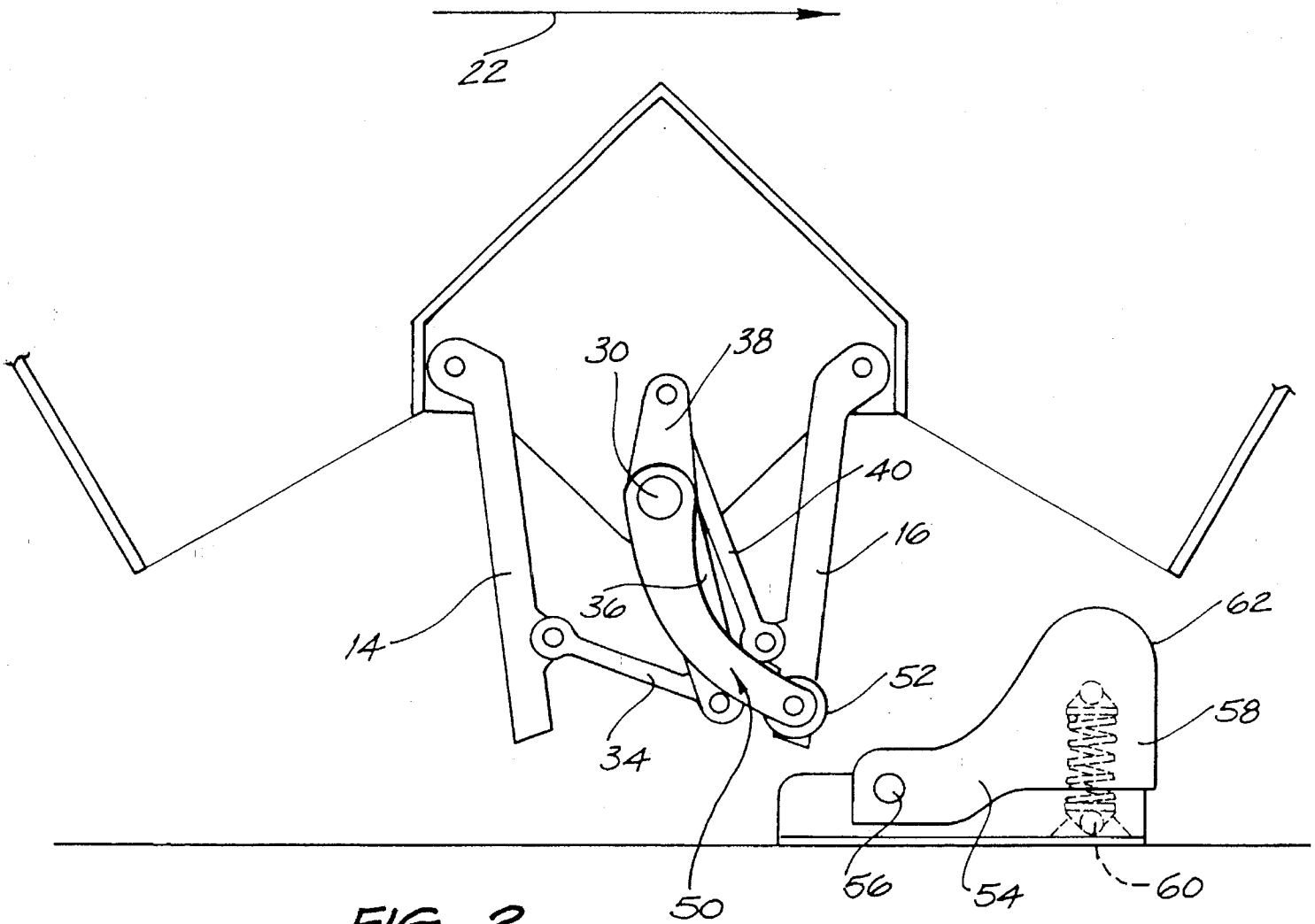
FIG. 2 shows the system of FIG. 1 illustrating the start of the closing operation with the doors in a fully open position.

Once discharge of the material is effected, the linkages 36, 38 and linkages 34, 40 are in the positions shown in FIG. 2. To close the hopper doors 14, 16 the hopper 10 is moved again or continues to move in the direction of the arrow 22. A second trip lever 50 attached to the shaft 30 in a parallel vertical plane to that of trip lever 24 operates to close the hopper doors 14, 16 in a manner to be described below.

As the trip lever 24 is rotated into its inoperative position (upwards) with the shaft 30 rotating clockwise, the trip lever 50 is rotated (downwards) into its operative position.

At the free end of the trip lever 50, a roller 52 is provided. A door closing cam 54 is situated in the path of the hopper 10 and lever roller 52. Cam 54 may be disabled as required (refer FIGS. 5–8 or 11–14).

The door closing cam 54 is provided with a steep double curvature profile to effect closure of the hopper doors 14, 16. In addition, the cam 54 may be pivoted at 56 and spring loaded at the opposite end 58. The internal spring 60 is of sufficient stiffness to kick the levers over-centre and to deflect downwardly as the trip lever 50 rolls over the crest 62 of the cam 54.

Figure 3:
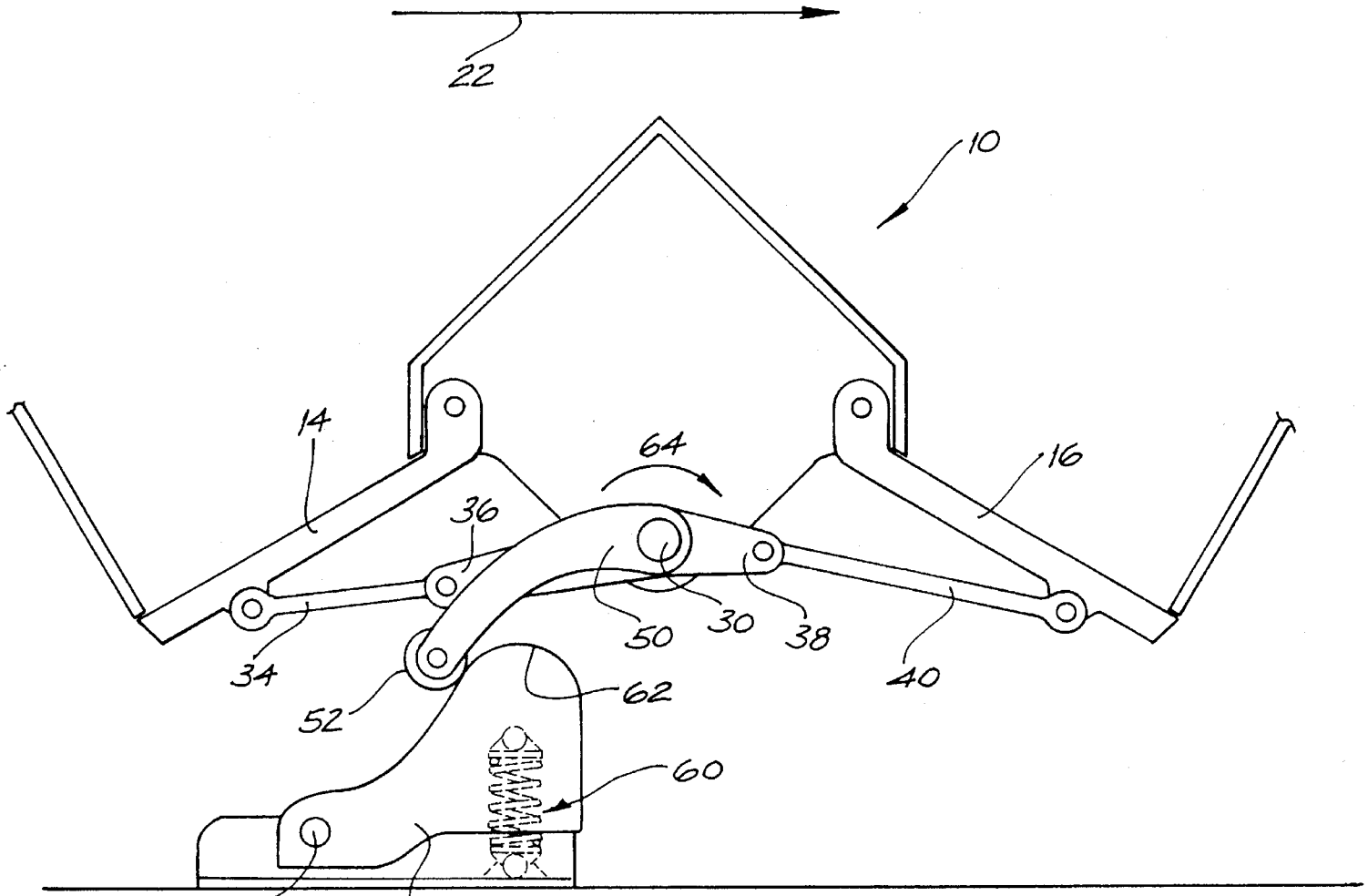
FIG. 3 shows the system in the operation of closing the hopper doors of the embodiment of FIG. 1.

As the lever 50 moves along the surface of the cam 54, the shaft 30 rotates clockwise as shown by arrow 64 in FIG. 3, which shows the doors in a position about to be closed fully. As the hopper 10 moves further in the direction of the arrow 22, the lever 50 disengages from the cam surface at 62.

As the closing lever 54 operates to shut the doors 14, 16, the opening trip lever 24 is rotated clockwise into an operative position.

The sloping surfaces of the the cams 28, 54 are of sufficient extent to cater for variations in heights of door operating main shafts 30 which may be experienced in vehicles in practice bearing in mind wear in wheels (of railway vehicles or tires of road vehicles), spring deflections in vehicle suspensions and the like. The maximum height of cam 28, 54 will be below the lowest position of the door operating main shaft 30 bearing these factors in mind.

Referring to the second embodiment as shown in FIG. 4, a vehicle with a hopper 110 filled with particulate material 112 has a single hopper door 114 hinged at 118 and closing opening 116. The door 114 is of a "flush-close" type, fitting over the opening 116.

"Flush-close" style doors close off a hopper opening by covering the opening externally. "Flush" in this sense may not necessarily require that the door be in contact with the rim of the opening but may include a gap therebetween, when the gap is smaller than the size of the particulate material to be contained, for example, coal. If required, for granular material in particular, sealing (or a gasket) around rim of the door can be provided.

The door 114 is operated by a lever arrangement similar to that of the first embodiment comprising articulated linkages 134, and 136. First linkage 136 is fixed to the shaft 130 at the end of yoke plate 138 and rotates therewith. Shaft 130 is supported at the end of yoke plate 138. Second linkage 134 is attached to first linkage 136 at pivot 142 and to the door 114 at pivot 144. Trip lever 124 and cam roller 126 open the door 114 when shaft 130 is rotated in the direction of arrow 132 (when the hopper 110 moves relative to cam 128 in the sense of arrow 122). A second trip lever (not shown) attached to the shaft 130 in a parallel vertical plane to that of trip lever 124 operates to close the hopper door 114 by rotating shaft 130 in the opposite direction to arrow 132.

The operation of the single door is essentially the same, mutatis mutandis, as described with respect to the embodiment of FIGS. 1–3. That is trip lever 124 and cam roller 126 open the door 114 by traversing opening cam 128 and the second trip lever closes the door by traversing a closing cam.

In some circumstances especially with a "plug-in" door the over-centre locking of the lever mechanism may not be sufficient to retain the door closed. "Plug-in" style doors close off the hopper opening by moving into the internal area of the opening without substantial contact with the rim of the opening.

For example vertical acceleration of the door imparted by surface irregularities ("bumping"), as a wagon moves along a railway track, may be sufficient to force the linkages 34, 36 past the neutral position where the linkages 34, 36 are aligned, especially when the hopper is empty. Once past this position the door will continue to open under the weight of the enclosed material or, if the hopper is empty, the weight of the doors themselves. This false tripping is less likely with a "flush-close" door (as shown for FIGS. 1–4) where to pass the neutral position, elastic deformation of the door is required.

Figure 9:
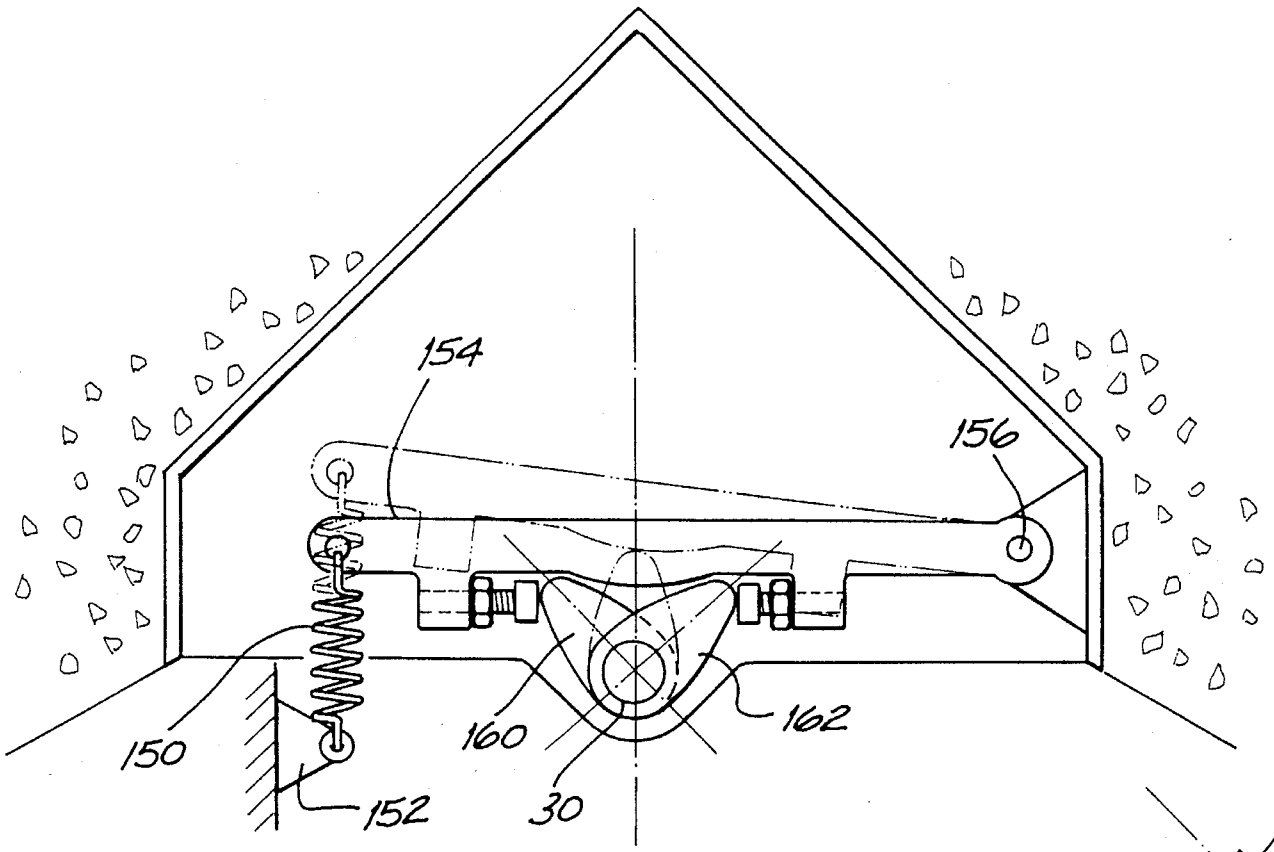
FIGS. 9–10 show schematic views of further embodiments of the invention showing subsidiary details.

Referring to FIG. 9, to prevent or reduce false opening of a door a tension spring 150 can be provided as a secondary lock anchored at one end to the vehicle at 152 and at the other end attached to lever 154. Alternatively, a counter weight may be used in place of the spring 150.

The lever 154 in turn rotates about pivot 156. A cam attached to the door operating shaft 30 can move between door open and door closed positions 160, 162 respectively when the lever 154 is in the raised position. To rotate the lever 154 to this position, the restoring force of the spring 150 must be overcome. Adjustable stops 166, 168 can be provided to specify the angular excursion of the cam in the open and closed positions 160, 162 respectively.

Figure 10:
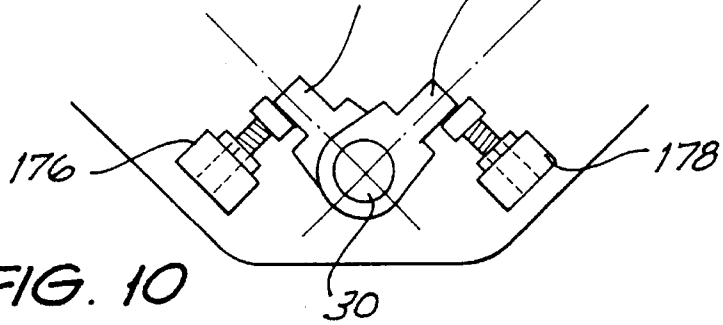

A governor may also be included with "flush-close" doors to limit the excursions of the main door operating shaft 30, as shown in FIG. 10. In this embodiment, a stepped bar can be rotated between door open and door closed positions 170, 172 respectively determined by screw adjustable stops 176, 178.

The opening and closing cams 28, 54 may be moved between operative and inoperative positions as shown in FIGS. 5–8. When inoperative a vehicle may traverse the cams without actuating the opening or closing of the hopper doors as the case may be. For example, when the cams are in their inoperative positions reversing of the vehicle over the cams is possible. For brevity the embodiments of FIGS. 5–8 are illustrated with respect to the operation of an opening cam only but would equally apply to either form of door operating cam.

Figure 5:
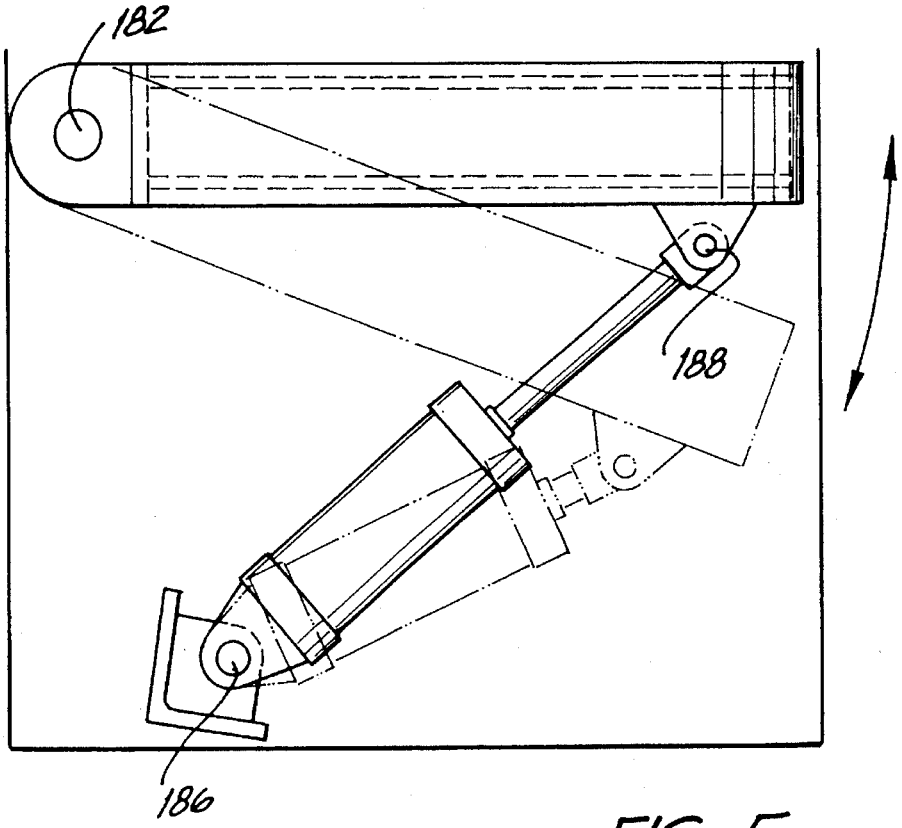
FIGS. 5–6 show schematic views in plan and elevation of a third embodiment of the invention showing means disabling the cams as shown in FIGS. 1–4.
Figure 6:
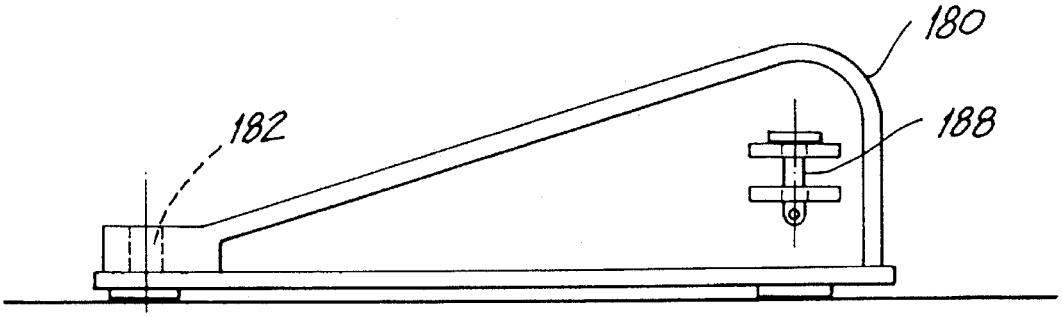

In FIGS. 5, 6 the cam 180 is hinged at 182 and further includes hydraulic or pneumatic actuator 184 with extensible rod 185. Actuator 184 is connected between pivots 186, 188 for rotating the cam 180 out of the path of the trip lever to inactivate the cam. Typically, only a small rotation angle is required to move the upper part of the cam 180 out of the rolling stock structure gauge (of a railway wagon).

Figure 7:
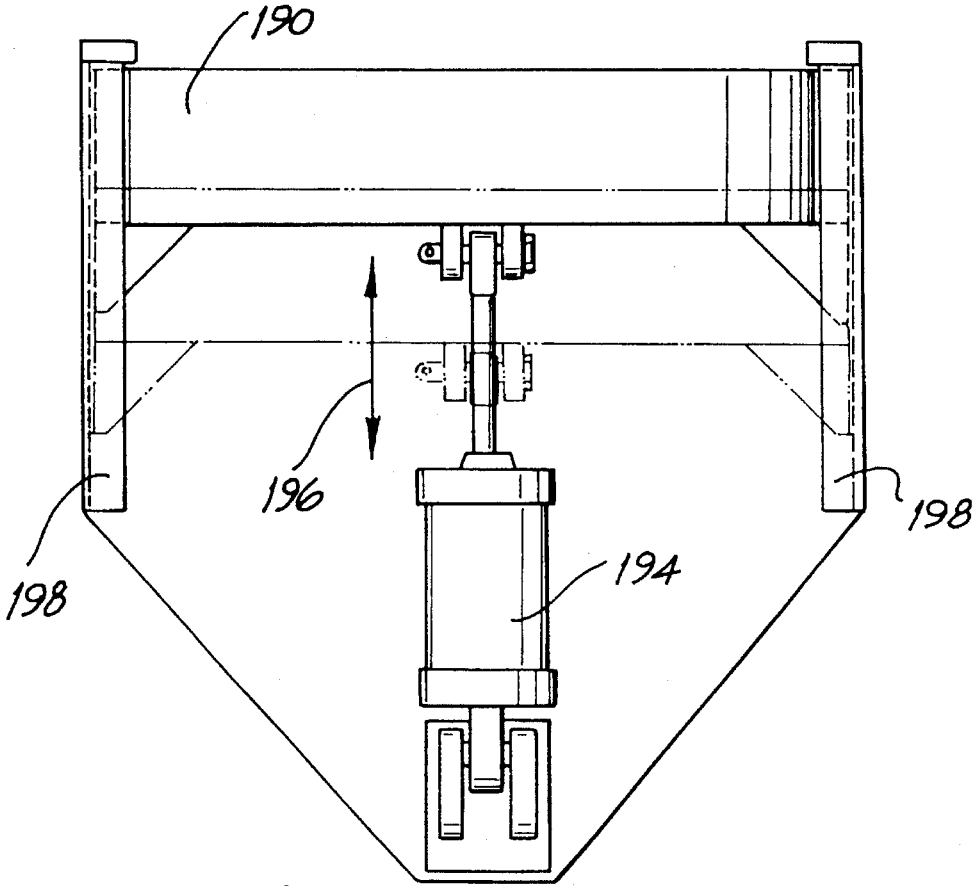
FIGS. 7–8 show schematic views in plan and elevation of a fourth embodiment of the invention showing means disabling the cams as shown in FIGS. 1–4.
Figure 8:
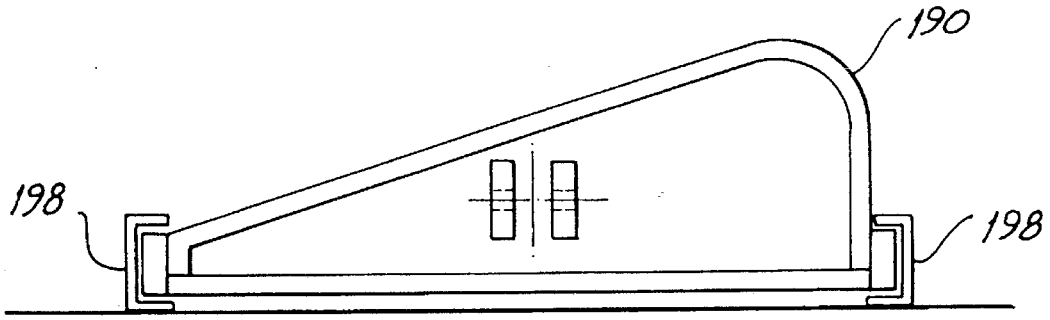

In alternative embodiment of FIGS. 7, 8 the cam(s) 190 could also be made inoperative by shifting the cam by hydraulic or pneumatic cylinder 194 in the direction 196 (perpendicular to the axis of the shaft 30), for example by mounting the cam 190 in sliding tracks 198.

Other means for disabling the cams 28, or 54 may be used, for example, they may be lowered out of the path of the cams rather than rotated or translated as in the embodiments of FIGS. 5–8.

Such an embodiment is shown in and will now be described with respect to FIGS. 11–14.

Figure 11:
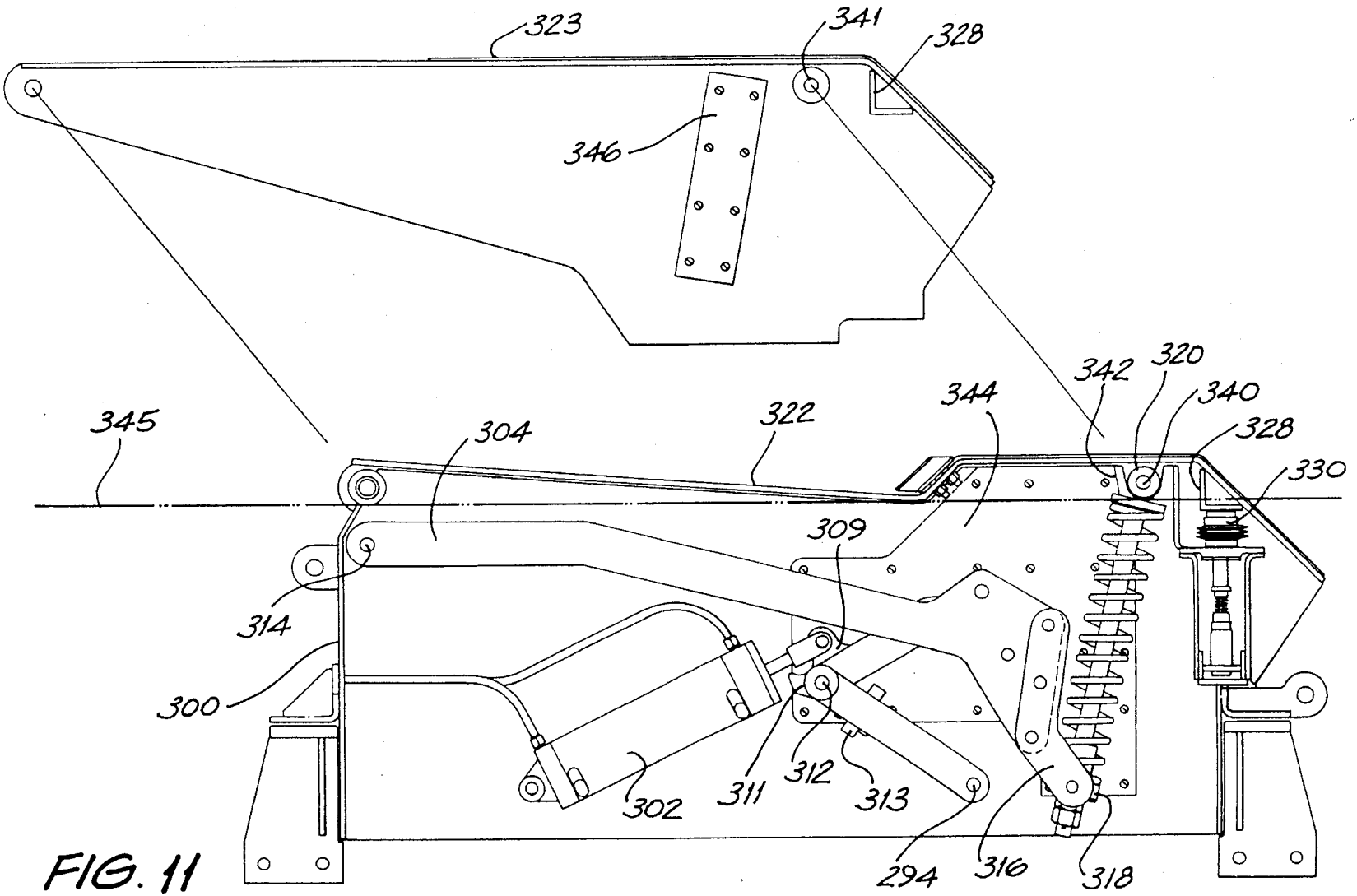
FIG. 11 shows a cross-sectional view in elevation of a further embodiment of means for operating the cams of FIGS. 1–4 in an inactivated position.
Figure 12:
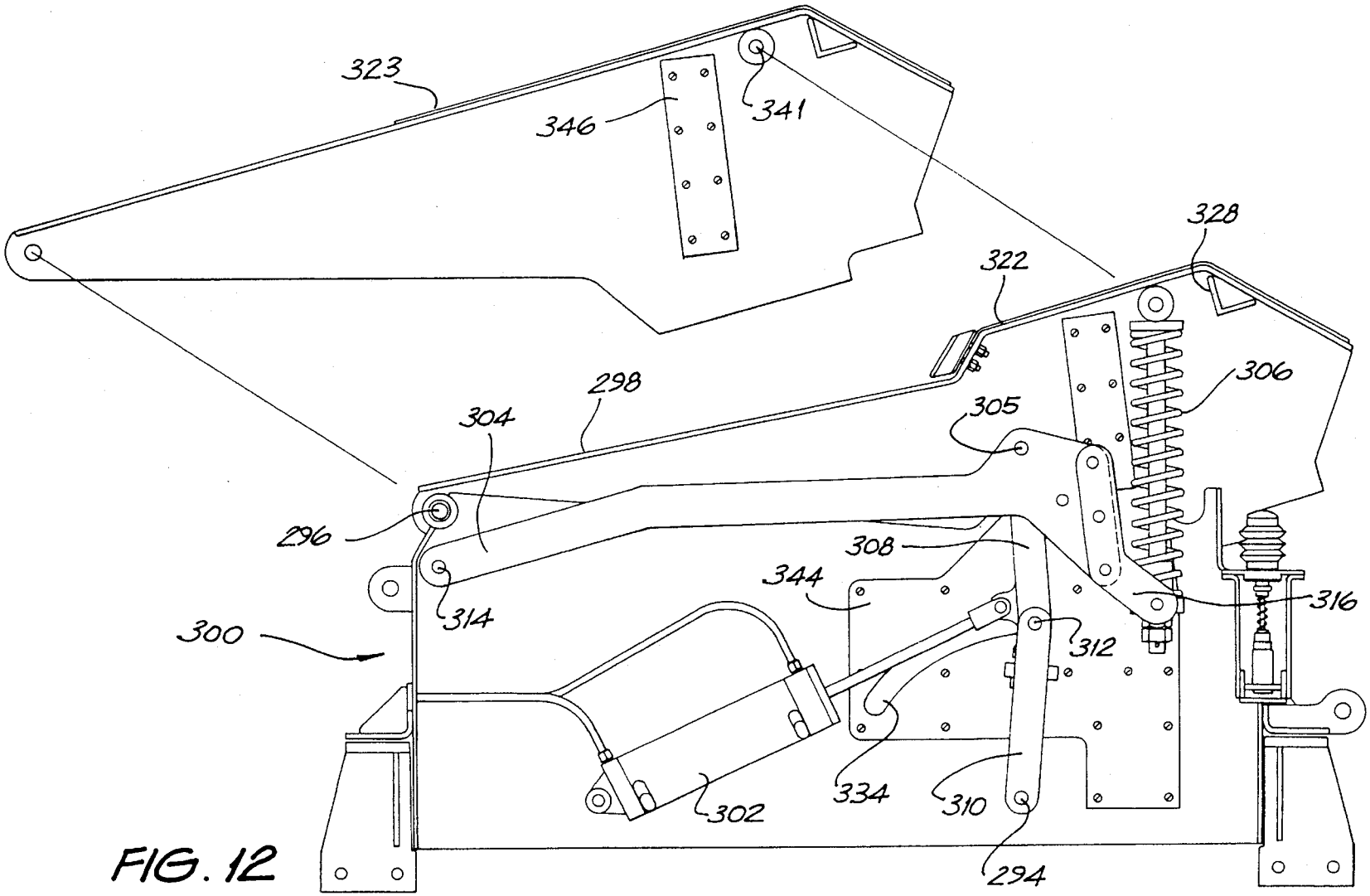
FIG. 12 shows the embodiment of FIG. 11 in the activated position.

The cam means comprises a fixed base or housing 300 covered by a cam lid 298 pivoted at upstream end 296 of the housing 300. FIG. 11 shows the cam lid 298 in the retracted position and FIG. 12 shows the cam lid 298 in the fully extended position (to engage the associated door operating lever). In the retracted or rest position of cam lid 298 the uppermost part of the mechanism sits approximately 80 millimeters above the level 345 of the top of the rail.

Housing 300 is installed such that the cam lid 298 can be placed in the path of the door operating lever in its active or extended position but is out of contact in the retracted or inoperative position. For a set of railway wagons, the cam lid would not be activated until the locomotive had passed. Housing 300 encloses the cam actuating mechanism which includes a pneumatic cylinder 302, a mechanical arm 304 incorporating an over-centre linkage, and spring 306. The over-centre linkage comprises a singular arm 308 hinged to a pair of arms 310. Arm 308 is additionally connected by a flange 309 to the drive rod of cylinder 302, and at its other end to arm 304 at pivot 305. The pair of arms 310 are rotatably fixed at 294 to housing 300 and pivot at their other end about arm 308.

The over-centre linkage operates in a well known manner and similar to that described above with respect to the linkages 34, 36, 38 and 40 for the door operating mechanism. The shape of the curved tongue 311 attached to the arm 308 acts as a cam which in co-operation with the adjustable nut 313 controls the amount of over-centre of the linkage.

Arm 304 pivots on the housing 300 at one end 314 and has a clevis 316, comprising a pair of arms, at the other end. The clevis 316 supports the base 318 of spring 306 which, at its other end 320, is pivotally attached by pin 340 to the cam lid 298. The exterior surface 322 of the cam lid 298 is shaped to the required cam profile. The cross-section of surface 323 shows an opening cam profile while that of surface 322 shows a closing cam profile.

In normal operation the cam surface 322, 323 is moved into its retracted and extended positions by feeding air to the cylinder 302. This may be done manually or automatically by operating a valve. The lid 298 is locked in place in its extended position as shown in FIG. 12 by the action of the over-centre linkage of arm 308 and arms 310.

In approaching the retracted position, stop 328 engages a shock absorber 330 which dampens any overtravel of the cam lid 298.

Figure 13:
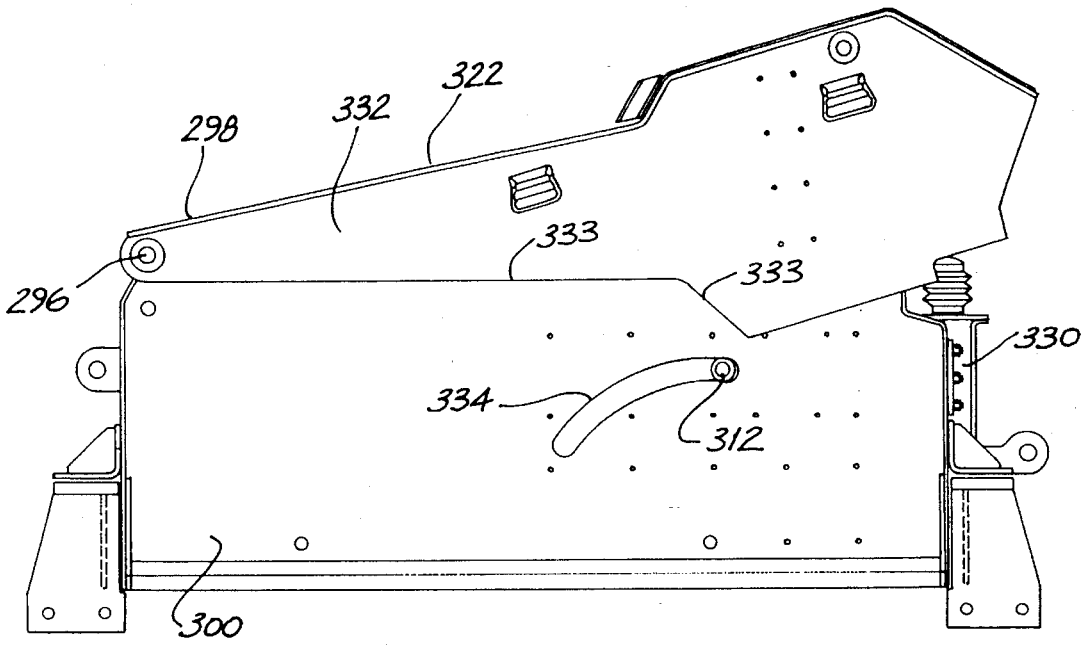
FIG. 13 shows an external view in elevation of FIG. 12 (activated position)
Figure 14:
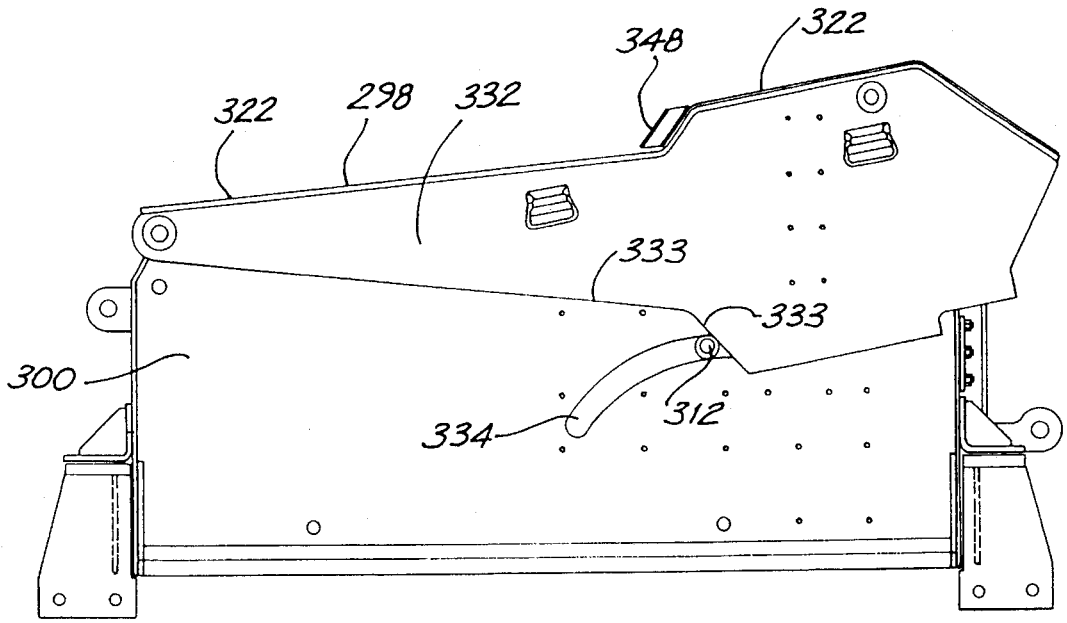
FIG. 14 shows an external view in elevation of FIGS. 11, 12 with the cam in the process of being deactivated.

Control of the movement of the cam lid 298 can also be achieved by the pin 312 affixed to the arm 304. As shown in FIGS. 13, 14 the cam lid 298 has sides 332 depending substantially vertically from surface 322, 323 over the sides of housing 300. Pin 312 extends through an arcuate slot 334 in the housing 300.

The sides 332 are shaped along their free edges in a profile 333 which engages pin 312 when sufficient deflection of spring 306 occurs with the cam lid 298 in the extended position due, for example to excessive force acting on the cam surface 322 and depending on the stiffness of the spring 306. The profile 333 determines the force driving the pin 312 along the arcuate slot 334. As it moves past a predetermined position, which can be adjusted by nut 313 as stated above, the pin 312 forces arms 308, 310 under-centre and the arm 304 collapses to retain the cam lid 298 in the down or retracted position of FIG. 11.

This function is designed to avoid damage to the cam mechanism through accidental collision with unintended and inappropriate objects, for example a locomotive.

The externally accessible linkage pin 312 also allows a manual operation of the cam activating mechanism in, for example, the case of air supply failure. The cam lid 298 can be lifted manually and locked in the over-centre position by using a hook to pull the protruding linkage pin 312 into the over-centre position. Similarly the cam lid 298 can be retracted by pulling the linkage pin 312 to the under-centre position as described above.

The spring 306 provides control of the motion of the cam lid 298 when the trip lever of a wagon is being engaged and also allows for variations in the position of the trip lever, or in the height of the wagon. The height of a wagon will depend upon a number of factors, including wear of the wheels or loading of the wagon, in particular asymmetric loading of the wagon which may place one side of the vehicle lower than the other.

The shape of the cam surfaces 322, 323 in particular in the case of the closing cam 322 is now more linear than as shown in FIGS. 1 or 2.

By having the cam lid 298 rest 80 millimeters above the surface 345 of the rail in its retracted position, and therefore above the grating normally installed at rail level at dumping stations, it is possible to easily remove it for servicing of the internal parts of the mechanism. This is done by removing the pivot pin at 296 and the pin 340 which holds the top end of the spring 306 within a rest or cradle 342 of housing 300. The rest 342 holds the top of the spring 306 in place when the cam lid is removed and the lid 298 can be replaced easily without having to realign the top of the spring with the hole 341 in the cam lid to accommodate the pin which secures the two together.

Plates 344 attached to the inside of the housing 300 and strips 346 on the inside of the cam lid 298 are synthetic low friction liners to facilitate respectively movement of the actuator-linkage mechanism and the cam lid. Associated strips (not shown) on the outside of the housing 300 align with the strips 346 on the inside of the cam lid 298. The plates 344 provide lateral restraint for the actuator-linkage mechanism.

A rubber buffer 348 is provided at the start of the opening cam 322 to reduce the shock and wear to the cam.

Preferably, the vehicle moves relative to stationary cams relying on the force and momentum of the vehicle's motion to operate the levers. However, operation of the opening and closing cam surfaces may be achieved by moving the cams relative to the vehicle's hopper doors with the vehicle substantially stationary.

Thus a cam-operated opening and closing system has been disclosed without the reliability problems and power requirements of prior art hydraulic or pneumatic actuators. The operation of the opening and closing of the hopper doors is effected by the relative motion of the hopper with respect to the cam surfaces. The hopper need only be moved relative to the first and second cam surfaces to effect the opening or the closing action thereof.

Obviously in its application it can be used to provide sequential operation of the hopper doors on a single vehicle, or, particularly in the case of railway wagons, of several vehicles (wagons).

The invention is made of materials suitable for the purpose for the construction of vehicles of the required type as well-known to a person skilled in the art.

Other variations are contemplated within the knowledge of a person skilled in the art.

What is claimed is:

1. A system for a discharge of bulk materials from a vehicle, said vehicle having at least one storage compartment with at least one discharge opening and a door covering said at least one discharge opening, held shut by an over-center action of a door operating mechanism having an articulated linkage, said door operating mechanism further including a first lever means for opening said door, and a second lever means for closing said door, a first cam means cooperable with said first lever means to open said door and a second cam means cooperable with said second lever means for closing said door, said first cam means and said second cam means being separate from said vehicle and each having means for moving said respective cam means between a first inoperative position and a second operative position and vice versa, so that in said second position said first cam means or said second cam means is in a position for contacting said first lever means or said second lever means, respectively, as the case may be, so that relative movement of said vehicle and said respective cam means opens or closes said door, and in said first position is retracted and unable to contact said respective levers; and, trip means attached to said each of said means for moving respective said first cram means and said second cam means operative for returning respective said first cam means and said second cam means to, and lock in, said first position whenever movement of respective said first cam means and said second cam means under loading in a direction of said first position exceeds a predetermined value.

2. The system for a discharge of bulk materials from a vehicle as claimed in claim 1, wherein said storage compartment has a pair of discharge openings and a door covering each of said discharge openings, each with a hinge transverse to a longitudinal axis of said vehicle, with said first lever means and said second lever means being affixed to, and rotating, a shaft, which is fixed to a medial region of said vehicle so that when each said door opens, each said door shields said shaft and said door operating mechanism from the discharge of material, and first and second articulated linkage means connected respectively between said shaft and each said door wherein each of said first and second articulated linkages comprises a pair of hinged linkages fixed pivotally at one end to said door and fixed rigidly at another end to said shaft for rotating therewith.

3. The system for a discharge of bulk materials from a vehicle as claimed in claim 2, further including means attached to said vehicle biasing said first articulated linkage means and said second articulated linkage means into a closed position of said doors for resisting accidental operation of said door operating mechanism during transport of said bulk materials by said vehicle.

4. The system for a discharge of bulk materials from a vehicle as claimed in claim 3, wherein said biasing means includes a third lever means pivoted at one end to the vehicle and loaded at another end by resilient damping means restraining the pivotal movement of said third lever means, first and second stops fixed to said third lever means and corresponding to said door being open or closed respectively, and armature means fixed to, and rotatable with, said shaft between said first and second stops, said third lever means restraining rotation of said armature means whereby said armature means must pivot said third lever means against a loading of said damping means to move between said first and second stops.

5. The system for a discharge of bulk materials from a vehicle as claimed in claim 2, wherein said means for moving respective said first cam means and said second cam means includes means for rotating said respective cam means between said first position and said second position.

6. The system for a discharge of bulk materials from a vehicle as claimed in claim 5, wherein each said cam means is pivoted about an axis perpendicular to that direction of movement of said vehicle to effect a discharge, the pivot being upstream of said movement, and said cam means being driven into, and maintained at, said second position by an actuator extending a folded articulated linkage into a locked over-center configuration, and further comprising resilient means joining said folded articulated linkage to said cam means and wherein said trip means is operative for returning respective said first cam means and said second cam means to, and lock in, said first position whenever travel of said cam means under loading exceeds a predetermined angle or travel of said resilient means exceeds a predetermined depth, said trip means comprising an arm attached to said folded articulated linkage.

7. The system for a discharge of bulk materials from a vehicle as claimed in claim 6, wherein each of said cam means includes a top surface and a side surface, said top surface being shaped for providing an opening or closing cam profile for opening or closing said door, said side surface extending from said top surface and terminating in a free edge shaped, in part, for providing a trip means actuating cam profile for engaging and operating said trip means, said arm comprising a pin extending outwardly from said folded articulated linkage and engageable by said trip means actuating cam profile.

8. The system for a discharge of bulk materials from a vehicle as claimed in claim 7, wherein each of said first cam means and said second cam means further includes an impact absorbing buffer means adjacent said first position and resisting overtravel of said cam means when moving towards said first position.

9. The system for a discharge of bulk materials from a vehicle as claimed in claim 8, further including means attached to said vehicle biasing said first articulated linkage means and said second articulated linkage means into a closed position of said doors for resisting accidental operation of said door operating mechanism during transport of said bulk materials by said vehicle.

10. The system for a discharge of bulk materials from a vehicle as claimed in claim 9, wherein said biasing means includes a third lever means pivoted at one end to the vehicle and loaded at another end by resilient damping means restraining the pivotal movement of said third lever means, first and second stops fixed to said third lever means and corresponding to said door being open or closed respectively, and armature means fixed to, and rotatable with, said shaft between said first and second stops, said third lever means restraining rotation of said armature means whereby said armature means must pivot said third lever means against a loading of said damping means to move between said first and second stops.

11. The system for a discharge of bulk materials from a vehicle as claimed in claim 5, further including means attached to said vehicle biasing said first articulated linkage means and said second articulated linkage means into a closed position of said doors for resisting accidental operation of said door operating mechanism during transport of said bulk materials by said vehicle.

12. The system for a discharge of bulk materials from a vehicle as claimed in claim 11, wherein said biasing means includes a third lever means pivoted at one end to the vehicle and loaded at another end by resilient damping means restraining the pivotal movement of said third lever means, first and second stops fixed to said third lever means and corresponding to said door being open or closed respectively, and armature means fixed to, and rotatable with, said shaft between said first and second stops, said third lever means restraining rotation of said armature means whereby said armature means must pivot said third lever means against a loading of said damping means to move between said first and second stops.

13. The system for a discharge of bulk materials from a vehicle as claimed in claim 2, wherein said means for moving respective said first cam means and said second cam means includes means for translating respective said first cam means and said second cam means between said first position and said second position.

14. The system for a discharge of bulk materials from a vehicle as claimed in claim 13, further including means attached to said vehicle biasing said first articulated linkage means and said second articulated linkage means into a closed position of said doors for resisting accidental operation of said door operating mechanism during transport of said bulk materials by said vehicle.

15. The system for a discharge of bulk materials from a vehicle as claimed in claim 14, wherein said biasing means includes a third lever means pivoted at one end to the vehicle and loaded at another end by resilient damping means restraining the pivotal movement of said third lever means, first and second stops fixed to said third lever means and corresponding to said door being open or closed respectively, and armature means fixed to, and rotatable with, said shaft between said first and second stops, said third lever means restraining rotation of said armature means whereby said armature means must pivot said third lever means against a loading of said damping means to move between said first and second stops.

* * * * *